US008348461B2

(12) United States Patent
Wilcox et al.

(10) Patent No.: US 8,348,461 B2
(45) Date of Patent: Jan. 8, 2013

(54) LED APPARATUS AND METHOD FOR ACCURATE LENS ALIGNMENT

(75) Inventors: Kurt S. Wilcox, Libertyville, IL (US); Wayne Guillien, Franksville, WI (US); Scot Siebers, Racine, WI (US); Joel Kapellusch, Racine, WI (US)

(73) Assignee: Ruud Lighting, Inc., Racine, WI (US)

( * ) Notice: Subject to any disclaimer, the term of this patent is extended or adjusted under 35 U.S.C. 154(b) by 311 days.

(21) Appl. No.: 12/610,077

(22) Filed: Oct. 30, 2009

(65) Prior Publication Data

US 2011/0103051 A1 May 5, 2011

(51) Int. Cl.
*F21V 21/00* (2006.01)

(52) U.S. Cl. ..... 362/249.02; 362/249.01; 362/240

(58) Field of Classification Search ..... 362/227, 362/240, 249.01, 249.02, 236, 237, 267, 362/294, 373, 612, 613, 800
See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 5,617,131 | A | 4/1997 | Murano et al. | |
| 5,722,760 | A | 3/1998 | Chien | |
| 6,502,956 | B1 | 1/2003 | Wu | |
| 7,682,853 | B2 * | 3/2010 | Ashida | 438/28 |
| 7,736,019 | B2 * | 6/2010 | Shimada et al. | 362/244 |
| 7,766,509 | B1 | 8/2010 | Laporte | |
| 8,002,435 | B2 | 8/2011 | Laporte | |
| 2002/0062170 | A1 | 5/2002 | Skunes et al. | |
| 2004/0135876 | A1 | 7/2004 | Ueda et al. | |
| 2006/0022214 | A1 | 2/2006 | Morgan et al. | |
| 2007/0201225 | A1 | 8/2007 | Holder et al. | |
| 2008/0239722 | A1 | 10/2008 | Wilcox | |
| 2008/0266852 | A1 | 10/2008 | Valerio et al. | |
| 2008/0273327 | A1 | 11/2008 | Wilcox et al. | |
| 2008/0298056 | A1 | 12/2008 | Peterson | |
| 2009/0298376 | A1 | 12/2009 | Guillien | |
| 2011/0115360 | A1 | 5/2011 | Holder et al. | |

OTHER PUBLICATIONS

International Search Report and Written Opinion for PCT No. PCT/US10/02837. Date: Dec. 29, 2010. 6 pages.
International Search Report and Written Opinion for PCT No. PCT/US09/03224. Date: Jul. 24, 2009. 4 pages.

* cited by examiner

*Primary Examiner* — Hargobind S Sawhney
(74) *Attorney, Agent, or Firm* — Jansson Shupe & Munger Ltd.

(57) ABSTRACT

An LED apparatus of the type including (a) a mounting board having an LED-supporting surface with an LED device thereon and (b) a lens member over the LED device establishing a light path therebetween. The inventive LED apparatus includes a lens-aligning member having front and back surfaces and defining an aperture receiving the LED device therethrough such that the LED device protrudes beyond the front surface. The lens member includes a lens portion and a flange thereabout, the flange being attached to the front surface of the lens-aligning member such that the lens portion substantially surrounds the protruding LED device. The lens-aligning member has a first mating feature which is positioned and arranged for mating engagement with a second mating feature of the mounting board, thereby accurately aligning the lens member over the LED device by accurately aligning the lens-alignment member with the mounting board. Other aspects of the invention is a method for LED-apparatus assembly and a method for manufacturing custom high-efficiency LED lensing for LED-array modules.

28 Claims, 11 Drawing Sheets

LED APPARATUS AND METHOD FOR ACCURATE LENS ALIGNMENT

RELATED APPLICATION

This application relates to U.S. application Ser. Nos. 11/744,807, filed May 4, 2007, 11/744,422, filed on Jul. 6, 2007, and 12/473,017, filed on May 27, 2009. The contents of each of these applications are incorporated herein by reference.

FIELD OF THE INVENTION

This invention relates to lighting fixtures and, more particularly, to methods of assembling lighting fixtures of the type having LED emitters.

BACKGROUND OF THE INVENTION

In recent years, the use of light-emitting diodes (LEDs) for various common lighting purposes has increased, and this trend has accelerated as advances have been made in LEDs and in LED-array bearing devices, often referred to as "LED modules." Indeed, lighting applications which have been served by fixtures using high-intensity discharge (HID) lamps and other light sources are now increasingly being to be served by LED modules. Such lighting applications include, among a good many others, roadway lighting, parking lot lighting and factory lighting. Creative work continues on development of lighting fixtures utilizing LED modules. It is the latter field to which this invention relates.

High-luminance light fixtures using LED modules as light source present particularly challenging problems. High costs due to high complexity becomes a particularly difficult problem when high luminance, reliability, and durability are essential to product success. Keeping LEDs and LED-supporting electronics in a water/air-tight environment may also be problematic, particularly when, as with roadway lights and the like, the light fixtures are constantly exposed to the elements. Use of a plurality of LED modules presents further challenges.

Yet another cost-related challenge is the problem of achieving a high level of adaptability in order to meet a wide variety of different luminance requirements. In other words, providing a fixture which can be adapted to give significantly greater or lesser amounts of luminance as deemed appropriate for particular applications is a difficult problem. Light-fixture adaptability is an important goal for LED light fixtures.

The product safety of lighting fixtures creates an additional area of difficulty, and such fixtures are most often required to comply with standards put forward by organizations such as Underwriters Laboratories Inc. (UL) in order to gain acceptance in the marketplace. One such set of standards deals with the accessibility of the electrically-active parts of a fixture during operation, and, more importantly, during periods of stress on the fixture such as in a fire situation during which some elements of the lighting fixture are compromised. The UL "finger test" mandates that a human finger of certain "standard" dimensions (defined in NMX-J-324-ANCE, UL1598, Dec. 30, 2004, FIG. 19.22.1, page 231) should not be able come in contact with any electrically-live parts of the fixture under such circumstances. The standards also establish certain material limitations on the enclosures of such products, all of which are dependent on the voltages and power levels within the fixtures.

Increased product safety can be costly to achieve and reduced optical efficiency in many cases may be a result of improving product safety. For example, placing a fixture behind a sheet of glass to provide increased safety can result in an optical efficiency loss of up to 10%.

For LED-based lighting fixtures, the cost of the power supply is an important part of the overall fixture cost. When a large number of LEDs are used to provide the necessary level of illumination, it is advantageous to use a single power supply providing higher voltages and higher power levels, which, in turn, requires more stringent safety standards. In particular, power supplies with a Class 2 power supply rating are limited to 100 watts at a maximum of 60 volts (30 volts if under wet conditions). LED-based lighting fixtures with a large number of LEDs can benefit (both by cost and efficiency) by using a Class 1 power supply, in which both the power and voltage limitations of a Class 2 power supply are exceeded. If power requirements for a lighting fixture are higher than the Class 2 limits, then multiple Class 2 power supplies are required (which can be costly) unless the more stringent safety standards which using a Class 1 supply brings about can be achieved.

As mentioned above, such more stringent requirements include satisfying the "finger test" under certain fire conditions during which it is possible that lighting module elements such as lenses made of polymeric materials may be removed. For example, in an LED device with a primary lens made of glass and a secondary lens made of polymeric material, it is necessary to provide enclosure barriers over the entire electrical portion of the module (on which the LED devices are mounted) except over the primary lenses. It is assumed that under these circumstances, the polymeric secondary lenses will be destroyed in the fire, leaving the primary lenses exposed. Also for example, if a single polymeric lens is used in place of both the primary and secondary lenses, then the enclosure barriers must prevent "standard finger" access to the electrical elements in situations in which the single lens is no longer in place.

Thus there is a need for improved LED lighting fixtures which can better serve the requirements of general-illumination lighting fixtures and which can provide both the safety and cost-effectiveness which the marketplace requires and/or prefers.

In short, there is a significant need in the lighting industry for an improvement in manufacturing lighting fixtures using LEDs, addressing the problems and concerns referred to above.

OBJECTS OF THE INVENTION

It is an object of the invention to provide an improved method for assembly of high-efficiency LED modules for use in lighting fixtures, such improved method overcoming some of the problems and shortcomings of the prior art, including those referred to above.

Another object of the invention is to provide a reduced-cost LED apparatus with high-efficiency LED-light distribution.

Yet another object of this invention is to provide an efficient and accurate assembly of the LED apparatus.

Still another object of the present invention is to provide a reduced-cost method of manufacturing of LED-apparatus with high-efficiency LED-light distribution.

Another object of this invention is to provide a method of reduced-cost manufacturing LED apparatuses providing a variety of different types of LED-light distribution.

How these and other objects are accomplished will become apparent from the following description and the drawings.

SUMMARY OF THE INVENTION

The present invention is an improvement in LED apparatuses of the type having an LED device defining a light-emission axis and a lens member positioned over the LED device and establishing a light path therebetween. The LED device is on a mounting board having an LED-supporting surface.

Prior LED devices had LED packaging of the type including reflectors and primary lenses surrounding LEDs. Such packaging may add material costs to manufacturing LED apparatus. The presence of the reflector in packaged LED devices may also reduce light-output efficiency due to added complexity in controlling orientation of reflected LED light. On the other hand, when the reflector is an a form of an aluminum ring which surrounds the LED, such reflector may serve as a reference for aligning the lens member over the LED device.

The LED apparatus of the present invention provides an important advantage in that it can utilize very small LED devices which include an LED configured for illuminating substantially white light and preferably without reflectors or substantial primary lenses. Some examples of LED devices have one or multiple number of light-emitting LEDs. Such multiple LEDs may emit light with the same wave length and produce a common-color light. Alternatively, multiple diodes may emit light of different waive lengths thus of different colors which may be blended to achieve a desired-color light. Persons skilled in the art would appreciate a broad variety of available LED devices.

The inventive LED apparatus includes a lens-aligning member having front and back surfaces and defining an aperture. The aperture is preferably configured to receive the LED device therethrough such that the LED device protrudes beyond the front surface. The lens member preferably includes a lens portion and a flange thereabout. The flange of the lens member is attached to the front surface of the lens-aligning member such that the lens portion substantially surrounds the protruding LED device. The lens-aligning member preferably has a first mating feature which is positioned and arranged for mating engagement with a second mating feature of the mounting board. The first and second mating features accurately align the lens member over the LED device by accurately aligning the lens-alignment member with the mounting board.

In preferred embodiments, the back surface of the lens-aligning member abut the LED-supporting surface of the mounting board. The first mating feature is preferably a protrusion extending from the back surface of the lens-aligning member. The second mating feature is a complementary hollow formed in the LED-supporting surface of the mounting board and receiving the protrusion. Each of the back surface of the lens-aligning member and the LED-supporting surface of the mounting board may have a pair of the mating features.

The lens-aligning-member front surface preferably has guide projections which extend from the front surface and have lateral surfaces engaging the edge of the lens-member flange.

The front surface of the lens-aligning member preferably includes a recess configured to snugly receive the flange therein. The guide projections preferably extend from the front surface with their lateral surfaces along the wall of the recess. The recess wall and the lateral surfaces are preferably engaging the edge of the lens-member flange.

Preferred embodiments of the inventive LED apparatus further include a cover which defines an opening aligned with the light path. A gasket is preferably pressed with the lens-aligning member between the cover and the mounting board thereby securing the lens member over the LED device. Such embodiments may further include a base member. The base member and the cover together preferably define an LED-apparatus interior which encloses and compresses the gasket with the lens-aligning member and the mounting board between the cover and the base member. Such gasket arrangement preferably provides a weather-proof seal about the LED device. The base member is preferably a heat sink providing heat dissipation from the LED device during operation.

In some embodiments, the inventive LED apparatus provides electrical safety by satisfying a set of stringent safety standards for the enclosures in which such LED apparatus are encased, and doing so in a cost-effective manner. In such embodiments, the lens-aligning member is a fireproof safety barrier having sufficient thickness for enclosure of electrical elements on the mounting board. The aperture is sized to permit light from the LED device to pass therethrough and through the lens portion of the lens member over such LED device to prevent finger-contact of electrical elements on the mounting board when the lens portion is not present.

In some embodiments of the LED apparatus, the barrier includes a metal layer, while in more preferred embodiments, the barrier also includes an insulating layer positioned between the mounting board and the metal layer. In some of these embodiments, the metal layer and the insulating layer form a laminate.

The safety barrier preferably includes a metal layer and an insulating layer. Such layers may be laminated together, forming the laminate. Alternatively, such layers may also be separate layers. Under certain UL standards, the metal layer may be made of a flat, unreinforced aluminum sheet having a thickness of at least 0.016 inches. The minimum thickness requirements of such metal layer depends on the structure and composition of the metal layer as set forth in the specific UL standards referred to above. If the lens-aligning-member safety barrier is a laminate, the different layers of the laminate may or may not have the same width and length dimensions.

The insulating layer may serves to electrically isolate the metal layer from the electrical elements on the mounting board. In some embodiments, these electrical elements may be isolated from the metal layer by a conformal coating on the mounting board. Such conformal coating may be any of a number of available coatings, such as acrylic coating 1B73 manufactured by the HumiSeal Division of Chase Specialty Coatings of Pittsburgh, Pa.

The lens-alignment-member safety barrier may also be made of a single layer of polymeric material having a minimum thickness as set forth by the UL standards. Acceptable polymeric materials include BASF 130FR (polyethylene terephthalate with glass fiber reinforcement) supplied by the Engineering Plastics Division of BASF Corporation in Wyandotte, Mich. The layer has a minimum thickness of 0.028 inches. Other acceptable polymeric materials must satisfy certain detailed specifications related to material behavior such as hot-wire ignition, horizontal burning, and high-current arcing resistance, all of which are set forth in the UL standards referred to above. The safety barrier may be of the type disclosed in the above mentioned U.S. patent application Ser. No. 11/774,422, entire contents of which are incorporated herein by reference. However, any other known safety-barrier configuration may also be used.

The inventive LED apparatus may include a plurality of the LED devices spaced from one another on the mounting board and a plurality of lens members each establishing a light path with a respective one of the LED devices. In such embodiments, the lens-aligning member defines a plurality of apertures each of which receives a respective one of the LED devices therethrough such that the LED devices protrude beyond the front surface. Each lens member is attached to the front surface of the lens-aligning member with the lens portion substantially surrounding the respective one of the LED devices.

In some preferred embodiments, at least a subset of the lens members includes lens members configured such that each of them refracts light emitted by its respective LED device in a predominantly off-axis direction. In some of such embodiments, the lens members of such subset are arranged on the lens-aligning member to refract light in a common off-axis direction. In different embodiments with of such type, the lens members of such subset are arranged on the lens-aligning member such that at least two are oriented to refract the light in substantially different off-axis directions.

Another aspect of the present invention is a method for assembly of the inventive LED apparatus. The method includes the steps of providing the lens member, the lens-aligning member with and the mounting board. The lens-aligning member and the mounting board having the first and second mating features positioned and arranged for engagement with one another.

The lens-member flange is attached to the front surface of the lens-aligning member. The attaching may be by way of mechanical bond such as with a glue. It is preferred that the flange is attached to the lens-aligning member with a chemical bond, preferably by ultrasonic welding. The lens-aligning-member front surface preferably has guide members. The attaching step preferably includes a prior step of positioning the lens-member on the lens-aligning-member front surface such that the guide-projections' lateral surfaces engage the edge of the lens-member flange.

The lens-aligning member is placed over the mounting board such that the LED device protrudes through the aperture beyond the front surface. The first and second mating features are engaged to accurately align the lens member over the LED device by accurately aligning the lens-aligning member with the mounting board. The lens portion substantially surrounds the protruding LED device establishing a light path therebetween. The lens member is preferably secured over the LED device by securing the lens-aligning member with respect to the mounting board.

Preferred embodiments of the inventive method include further steps of powering the LED device and imaging the LED apparatus to test light-output characteristics. When the LED apparatus is fully assembled, a power is provided to the LED emitter. An image of the powered LED apparatus is then taken to test light-output characteristics. In preferred embodiments, the image of the LED apparatus is utilized to test intensity, light distribution and color temperature of the LED device(s).

The inventive method preferably includes further steps of providing a gasket member, a cover and a heat sink. The cover defines an opening aligned with the light path. The heat sink and the cover together define an LED-apparatus interior. The step of securing the lens-aligning member with respect to the mounting board is preferably by compressing the gasket with the lens-aligning member and the mounting board between the cover and the heat sink. This preferably provides a weather-proof seal about the LED device within the LED-apparatus interior. The inventive method preferably includes the further step of vacuum testing the seal for water-air/tightness of the LED-apparatus interior.

In the embodiments for assembling LED apparatuses with a plurality of spaced-apart LED devices, the lens-aligning member includes a plurality of apertures each configured for receiving a respective one of the LED devices therethrough; and a plurality of lens members are provided. In such embodiments, at least a subset of the lens members include lens members configured such that each of them refracts light emitted by its respective LED device in a predominantly off-axis direction. Prior to the attaching step, a specific type of the lens member is selected. Such selected lens members are positioned on the front surface of the lens-aligning member. The type of each lens member and its orientation are preferably verified.

In some of such embodiments the lens members of the subset are arranged on the lens-aligning member to refract light in a common off-axis direction. In different ones of such embodiments, the lens members of the subset are arranged on the lens-aligning member such that at least two are oriented to refract the light in substantially different off-axis directions.

Still another aspect of this invention is a method for manufacturing custom high-efficiency LED lensing for LED-array modules of the type including a mounting board having a plurality of LED devices spaced from one another thereon. During manufacturing of an individual separate lens member certain high-precision technologies are used to make an accurate shape of outer and/or inner surfaces of the lens portion. This is critical in achieving high-efficiency light output and distribution. Application of some of such high-precision technologies is limited when multiple lens portions are formed together in a single-piece lensing such that each of the multiple lens portions lacks some of the desired high-efficiency characteristics. This results in a loss efficiency of light-output and distribution. The inventive method allows to achieve the high accuracy of the individually-made lens portions which are securely arranged together for their placement over an LED-array module.

Such inventive method also allows to lower manufacturing costs by reducing an inventory of custom lensing. Such reduced inventory is also possible because of the use of individual lens members which may be positioned in various orientations and arrangements to accommodate different light-distribution patterns. Furthermore, based on the side of the LED-array module and the number of the LED devices on the mounting board, the inventive method allows for different number of the lens members to be arranged together. In other words, there is no need for having a special matrix-mold for making each specific lens configuration for each specific light-distribution pattern. Thus, there are cost savings on tooling for manufacturing each of the multitude of such special matrix-molds and the resulting specific lensing as well as the storage for the tooling, the molds and the multi-lens-portion lensing.

In such inventive method a plurality of separate individual lens members are provided. Each lens member includes a lens portion and a flange thereabout. It is highly preferred that the lens portion is made by using a precision technology which permits precise forming of each lens-member refracting surfaces for a specific type of high-efficiency light distribution. Also provided is a lens-support member which has front and back surfaces and defines a plurality of apertures each configured to receive a respective one of the LED devices therethrough. The lens-support member is placed over the mounting board such that each LED device protrudes through the respective aperture beyond the front surface.

The method includes the step of determining a desired light distribution of the LED-array module. Such determination may be based on the requirements for an area illumination or the desired illumination characteristics of an individual lighting fixture. According to the determined the desired light distribution, specific type(s) of the individual lens members are selected. The selected lens members are positioned on the front surface of the lens-support member to achieve such desired light distribution. The lens portion of each lens member is positioned to substantially surround a respective one of the LED devices. It is preferred that the type and orientation of each lens member are verified. It is further preferred that each lens member includes a machine-identifiable lens-indicia. In such embodiments, the steps of verifying the type and orientation of the lens members are accomplished by a vision system reading the machine-identifiable lens-indicia.

Each lens-member flange is substantially permanently attached to the front surface of the lens-support member. It is preferred that the attachment is by a substantially permanent chemical bond formed by ultrasonic welding of the flange with the lens-support member.

The lens-support member is preferably secured with respect to the mounting board to secure the lens members over the respective one of the LED devices. Such securement may be by compressing a gasket between the mounting board and a cover. Alternatively, the lens-support member may be secured to the mounting board by other suitable means available in the art.

In some preferred embodiments, the cover includes a plurality of screw holes. Prior to the step of vacuum testing, the method preferably includes the steps of inserting a screw into all but one of the plurality of screw holes. The cover preferably also includes a power connection which may be in various forms such as an electrical connector or a wireway opening. One example of the wireway opening is disclosed in commonly-owned U.S. Pat. No. 7,566,147(Wilcox et al.). When the power connection is in the form of the wireway opening, such wireway opening is sealed prior to the step of vacuum testing. The vacuum-testing step preferably utilizes the screw hole without a screw therein as an access point for the vacuum testing. It is highly preferred that the screws are inserted by using an automated screwdriver capable of controlling the torque utilized during the screw insertion for controlled pressure applied between the cover and the base member. The term "base member," while it might be taken as indicating a lower position with respect to the direction of gravity, should not be limited to a meaning dictated by the direction of gravity.

Some embodiments of this method are performed in such a way that the cover is initially positioned with a cover inner surface facing up. The gasket is preferably in a form of a gasket layer with a plurality of apertures each aligned with a respective aperture in the cover and the respective one of the light paths. In such embodiments, the gasket is placed on the cover inner surface. The lens-support member with the lens members attached to the front surface is placed with on the gasket the front surface being against the gasket. The mounting board oriented with the LED devices facing down is placed on the back surface of the lens-support member such that the first and second mating features are engaged to accurately align the LED devices with the lens members by accurately aligning the mounting board with the lens-support member.

It is preferred that at least the steps of positioning the selected lens members on the front surface of the lens-support member and verifying the type and orientation of each lens member are performed by a robot incorporating the vision system. For example, an ABB IRB340 FlexPicker Robot with IRC5 Controller can be utilized. The robot may also perform all other steps to complete assembly of the LED apparatus, including the step of imaging the LED apparatus to test light-output characteristics and the step of vacuum testing to verify the water-air/tight seal about the LED devices. Such robot is preferably present only at a single first location.

Further steps of incorporating the LED-apparatus assembly into light fixtures may be performed at multiple locations each of which is remote from the first location. Therefore, the inventive method allows to further lower manufacturing costs by eliminating the need for the robot at the multiple manufacturing locations.

In any of the described embodiments, it is preferred that the method further includes the step of providing a central database, whereby the central database provides assembly and testing parameters. It is also preferred that the method of the present invention is performed by an automated system receiving instructions from the central database for each particular step preformed by automated tool(s). The central database collects and stores data related to all or at least one of: the LED device and LED lens-member type, selection and orientation of the lens member, screw torque, vacuum testing parameters, light output and color testing procedures.

It is further preferred that the LED apparatus includes a unique machine-identifiable module-marking. Such machine-identifiable marking can be in any suitable form. Some examples of such marking may include a text, a set of symbols, a bar code or a combination of these marking types. The steps of the inventive method are preferably repeated multiple times to create a plurality of LED apparatuses. The method preferably includes a further step of reading the unique machine-identifiable module-marking. The data of each unique machine-identifiable module-marking is associated with a specific individual LED apparatus. Such data relates to that LED apparatus' LED devices(s), the type of the lens member(s) such as selection and orientation of the lens member(s), as well as light-output and color-testing procedures.

DETAILED DESCRIPTION OF PREFERRED EMBODIMENTS

Figure 1:
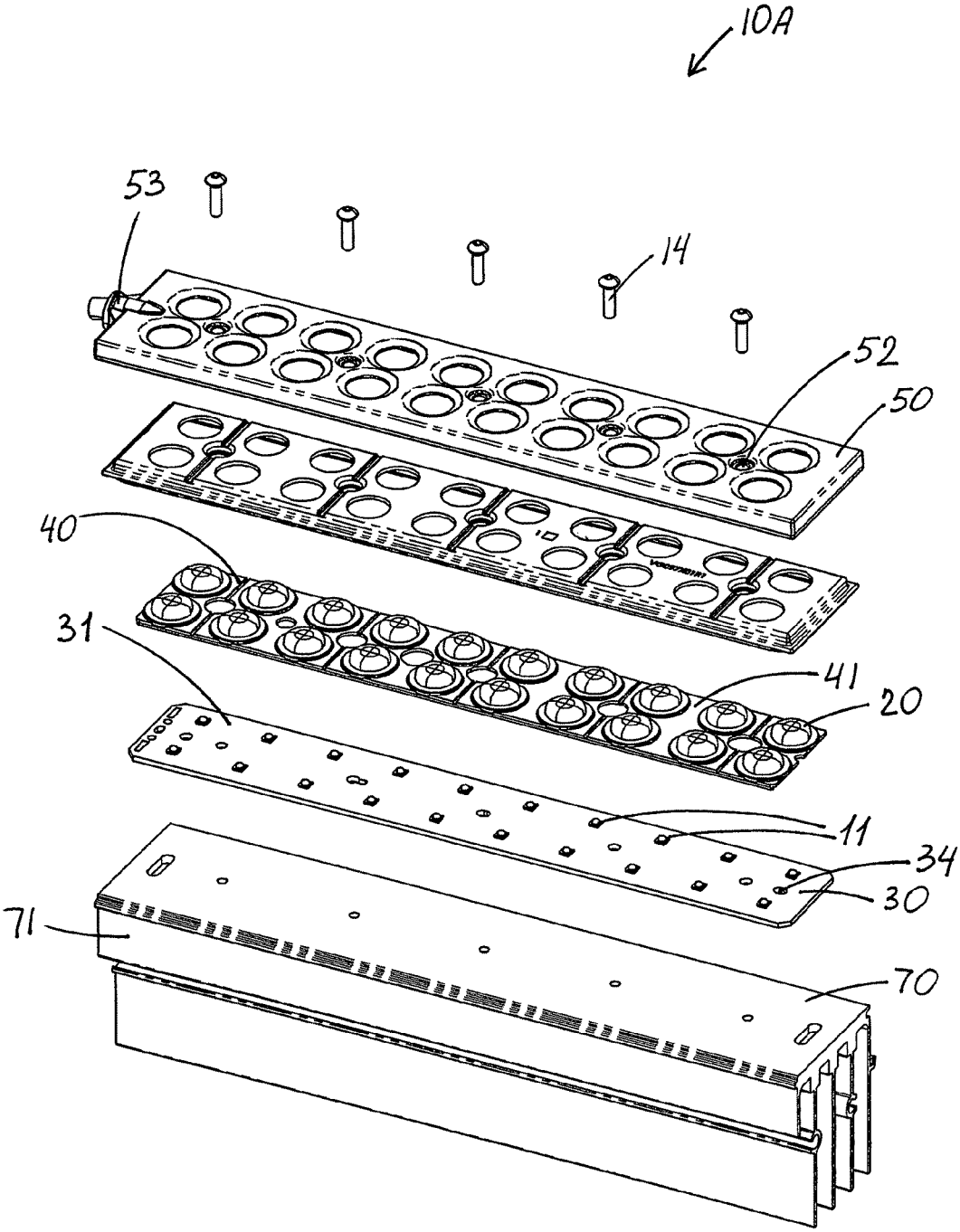
FIG. 1 is an exploded perspective view from above of an LED apparatus of preferred embodiment of this invention with a plurality of lens members attached to a lens-aligning member.

FIGS. 1-18 illustrate an improvement in LED apparatus 10 of the type having an LED device 11 defining a light-emission axis 12 and a lens member 20 positioned over LED device 11 and establishing a light path 21 therebetween. LED device 11 is on a mounting board 30 having an LED-supporting surface 31.

Figure 2:
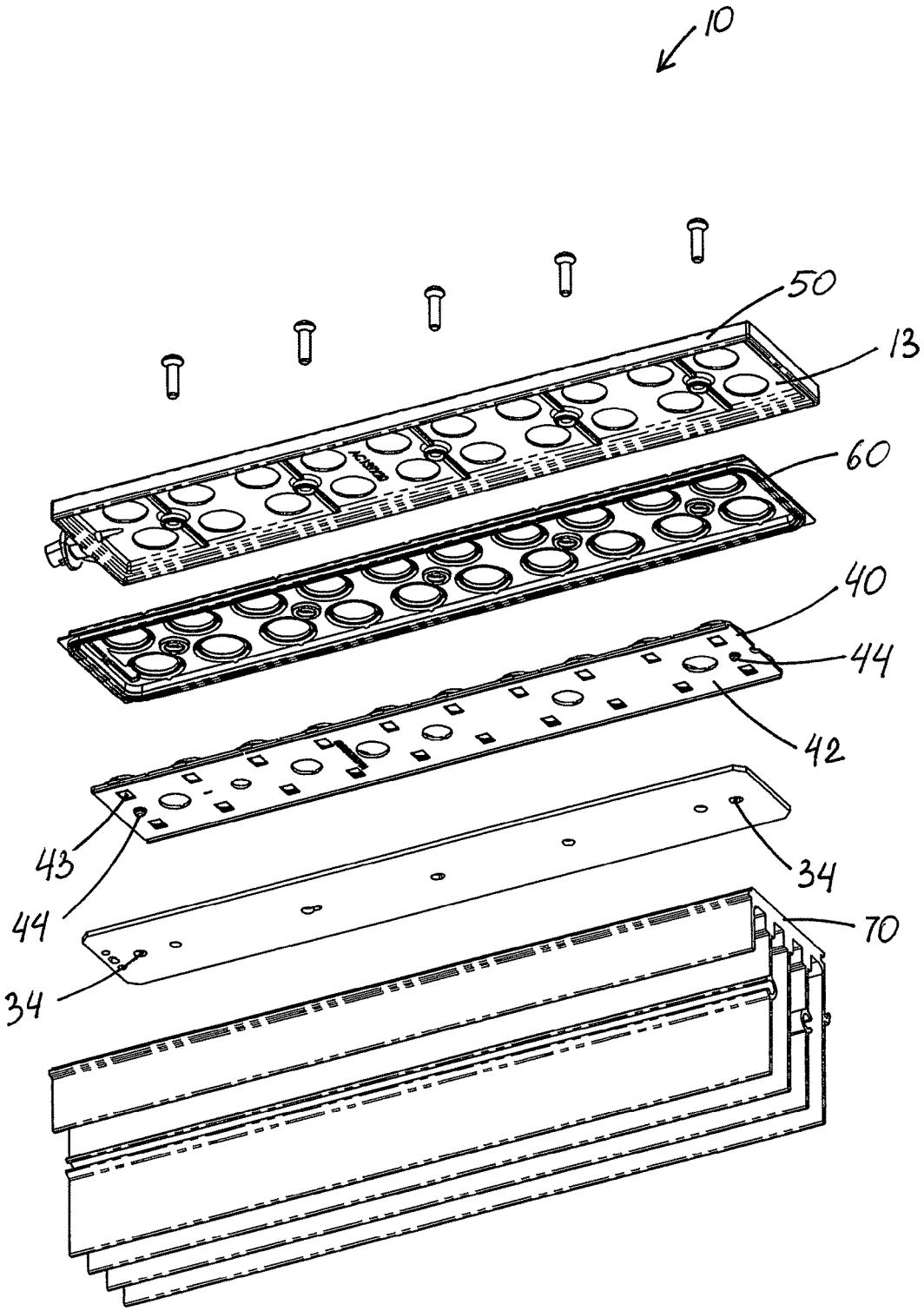
FIG. 2 is an exploded perspective view from below of an LED apparatus of FIG. 1.

As best seen in FIGS. 1 and 2, LED apparatus 10 of the present invention provides an important advantage in that it utilizes very small LED devices 11 which include an LED configured for illuminating substantially white light and preferably without reflectors or substantial primary lenses.

Inventive LED apparatus 10 includes a lens-aligning member 40 having a front surface 41 and a back surface 42 and defining an aperture 43. FIGS. 3-9 best illustrate that aperture 43 is configured to receive LED device 11 therethrough such that LED device 11 protrudes beyond front surface 41. FIGS. 1 and 7-12 show that lens member 20 includes a lens portion 22 and a flange thereabout 23. As seen in FIGS. 1 and 7-9, flange 23 of lens member 20 is attached to front surface 41 of lens-aligning member 40 such that lens portion 22 substantially surrounds protruding LED device 11. Lens-aligning member 40 has a first mating feature 44 which is positioned and arranged for mating engagement with a second mating feature 34 of mounting board 30. First and second mating features 44 and 34 accurately align lens member 20 over LED device 11 by accurately aligning lens-alignment member 40 with mounting board 30.

Figure 3:
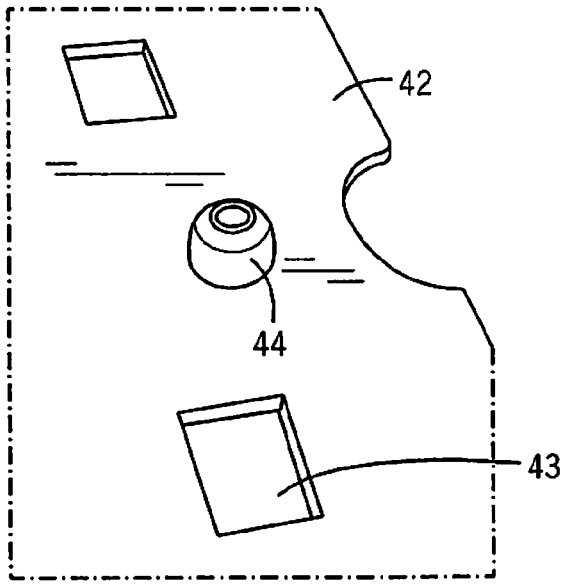
FIG. 3 is an enlarged fragmental perspective view of a back surface of the lens-aligning member.
Figure 9:
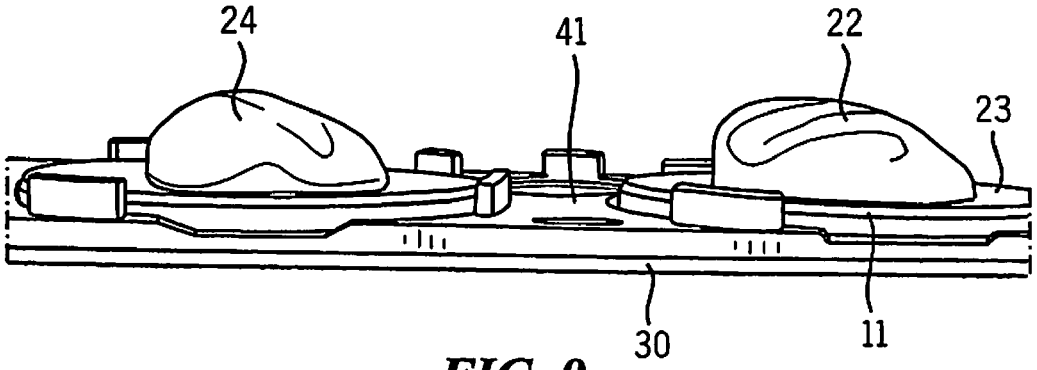
FIG. 9 is an enlarged fragmental perspective side view of the lens member attached to the lens-aligning member as in FIGS. 7 and 8.

FIG. 9 shows back surface 42 of lens-aligning member 40 abutting LED-supporting surface 31 of mounting board 30. First mating feature 44, as best seen in FIGS. 2 and 3, is a protrusion 44 extending from back surface 42 of lens-aligning member 40. As seen in FIGS. 1 and 2, second mating feature 34 is a complementary hollow 34 formed in LED-supporting surface 31 of mounting board 30 and receiving protrusion 44. FIG. 2 illustrates that each of back surface 42 of lens-aligning member 40 and LED-supporting surface 31 of mounting board 30 have a pair of mating features 44 and 34.

Figure 5:
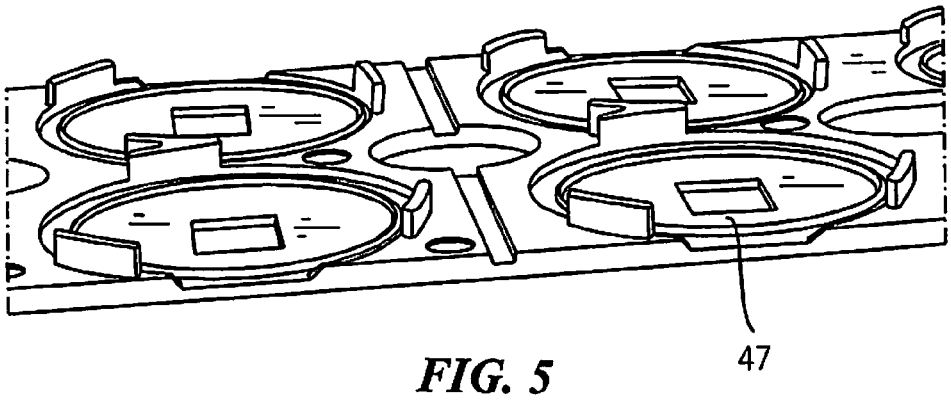
FIG. 5 is an enlarged fragmental perspective side view of the lens-aligning member.
Figure 6:
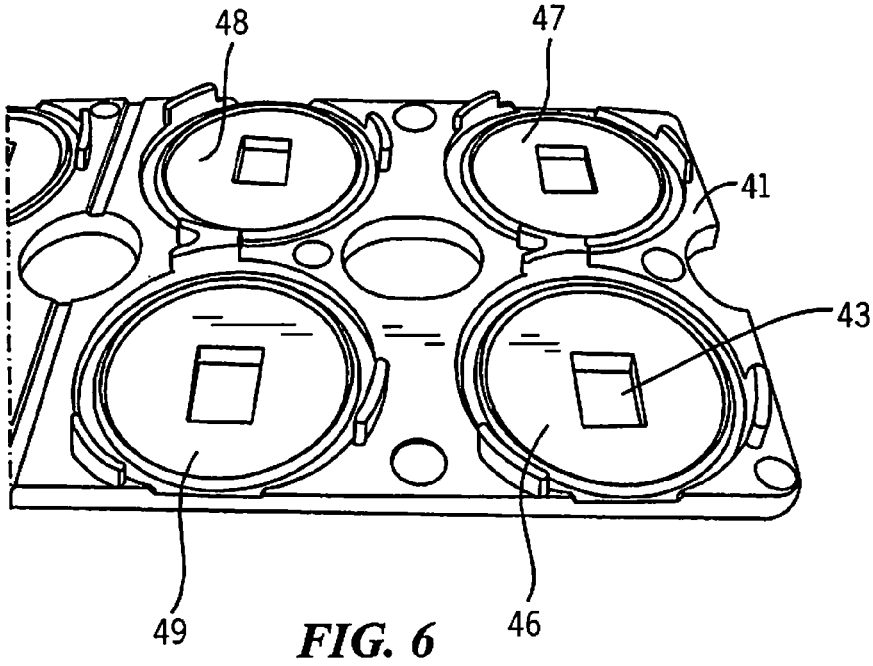
FIG. 6 is another enlarged perspective fragmental view of the front surface of the lens-aligning member as in FIG. 4.
Figure 7:
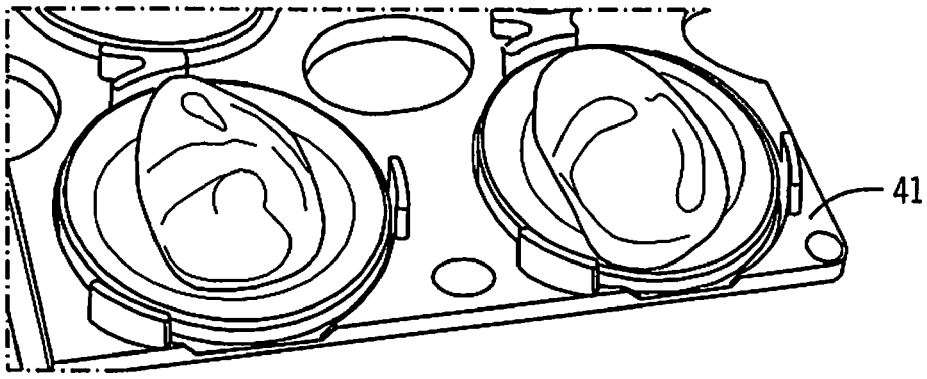
FIG. 7 is an enlarged fragmental perspective view from above of the lens member attached to the front surface of the lens-aligning member.
Figure 8:
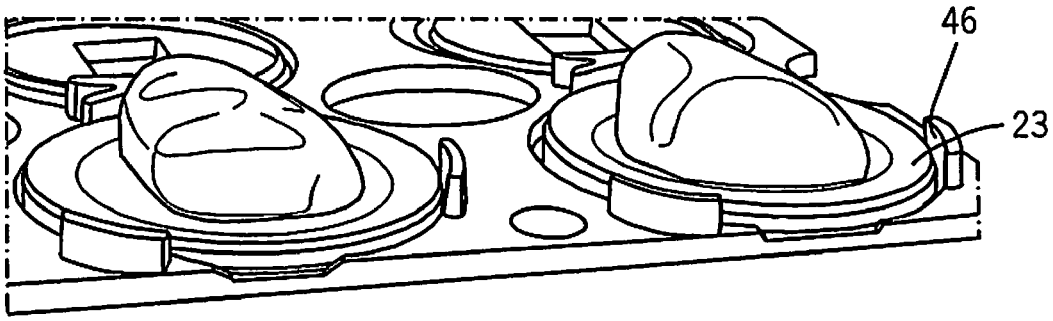
FIG. 8 is another enlarged fragmental perspective view of the lens member attached to the lens-aligning member as in FIG. 7.

FIGS. 4-9 further illustrate that lens-aligning-member front surface 41 has guide projections 45 which extend from front surface 41 and have lateral surfaces 46 engaging the edge of lens-member flange 23, as best seen in FIGS. 7-9.

Figure 4:
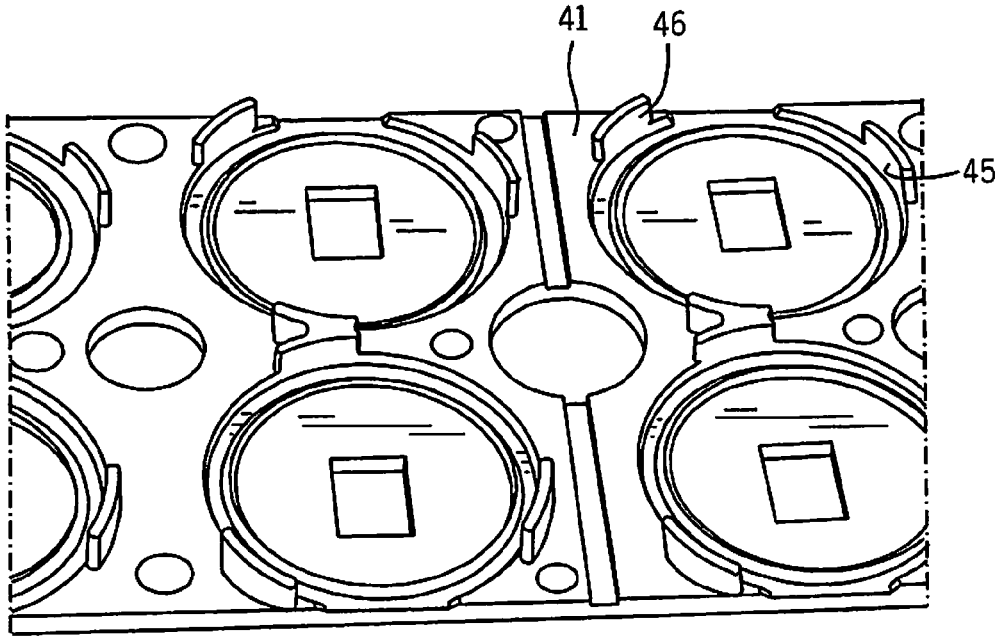
FIG. 4 is an enlarged fragmental perspective view of a front surface of the lens-aligning member.

In FIGS. 4-6, it is further seen that front surface 41 of lens-aligning member 40 includes a recess 47 configured to snugly receive flange 23 therein, as illustrated in FIGS. 7-9. FIGS. 5 and 6 best show that guide projections 45 extend from front surface 41 with their lateral surfaces 46 along wall 48 of recess 47. Recess wall 48 and lateral surfaces 46 are engaging the edge of lens-member flange 23.

Figure 10:
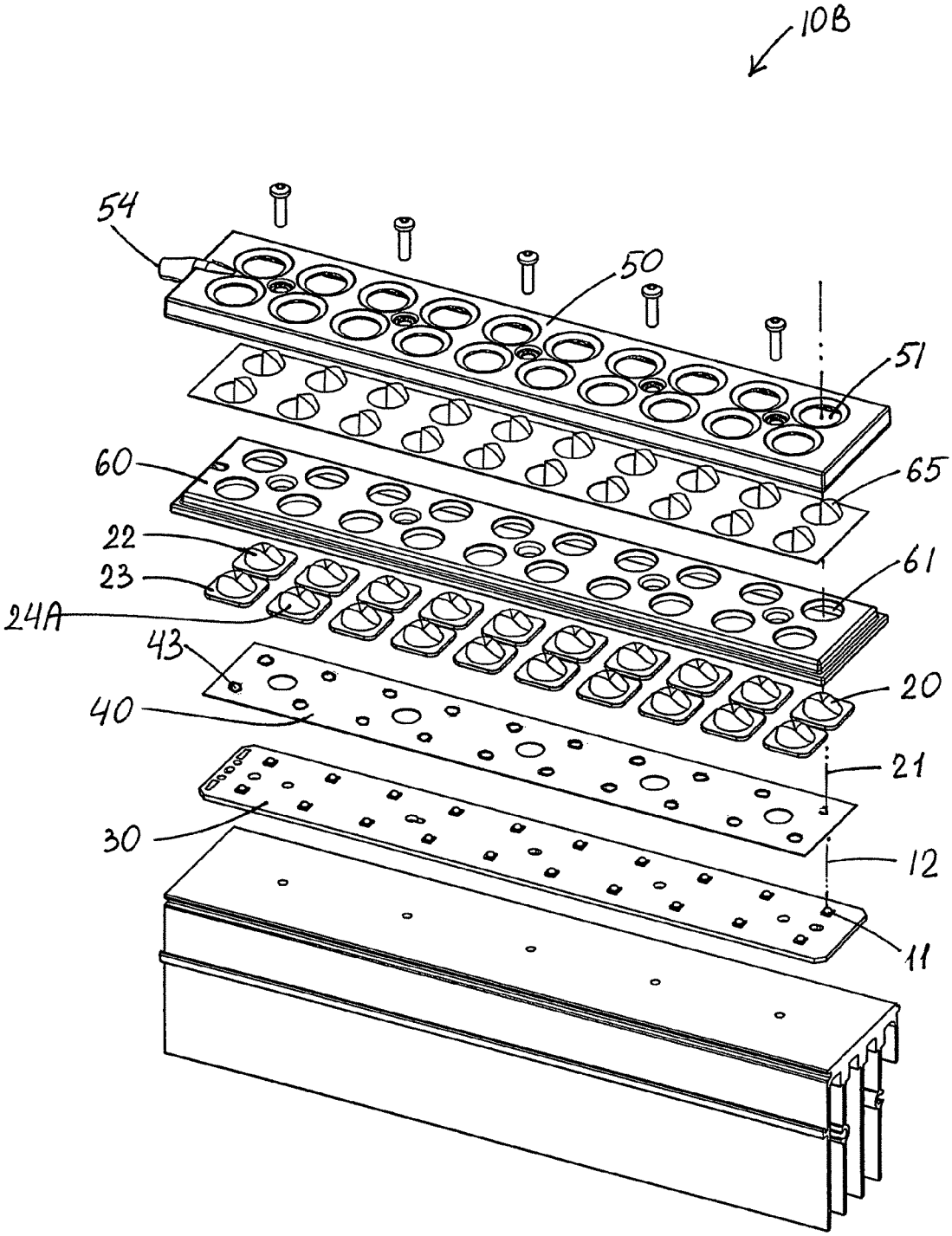
FIG. 10 is an exploded perspective view of a preferred embodiment of this invention showing lens members prior to attachment to the lens-aligning member.

FIGS. 1, 2, 10, 14 and 16 further show that inventive LED apparatus 10 further includes a cover 50 which defines an opening 51 aligned with light path 21. A gasket 60 seen in FIGS. 1, 2 and 10 is pressed with lens-aligning member 40 between cover 50 and mounting board 30 thereby securing lens member 20 over LED device 11. Gasket 60 has a plurality of gasket apertures 61 each aligned with respective light path 21 and is preferably made from closed-cell silicone which is soft or non-porous solid silicone material.

FIGS. 1, 2 and 10 further show a base member 70 as a heat sink 71 which providing heat dissipation from LED device 11 during operation. Base member 70 and cover 50 together define an LED-apparatus interior 13 which encloses and compresses gasket 60 with lens-aligning member 40 and mounting board 30 between cover 50 and base member 70. Such arrangement with gasket 60 provides a weather-proof seal about LED device 11.

FIG. 10 further shows that inventive LED apparatus 10 provides electrical safety by satisfying a set of stringent safety standards for the enclosures in which LED devices 11 are encased, and doing so in a cost-effective manner. FIG. 10 shows that lens-aligning member 40 is a fireproof safety barrier having sufficient thickness for enclosure of electrical elements on mounting board 30. Each apertures 43 is sized to permit light from the respective one of LED devices 11 to pass therethrough and through lens portion 22 of lens member 20 over such LED device 11, but to prevent finger-contact of electrical elements on mounting board 30 when lens portion 22 is not present.

FIGS. 1, 2, 10 and 13-17 show inventive LED apparatuses 10A-E including a plurality of LED devices 11 spaced from one another on mounting board 30 and a plurality of lens members 20 each establishing light path 21 with a respective one of LED devices 11. It is seen in FIGS. 1-10 that lens-aligning member 40 defines a plurality of apertures 43 each of which receives a respective one of LED devices 11 therethrough such that LED devices 11 protrude beyond front surface 41. FIGS. 1 and 7-9 illustrate each lens member 20 being attached to front surface 41 of lens-aligning member 40 with lens portion 22 substantially surrounding the respective one of LED devices 11.

Figure 11:
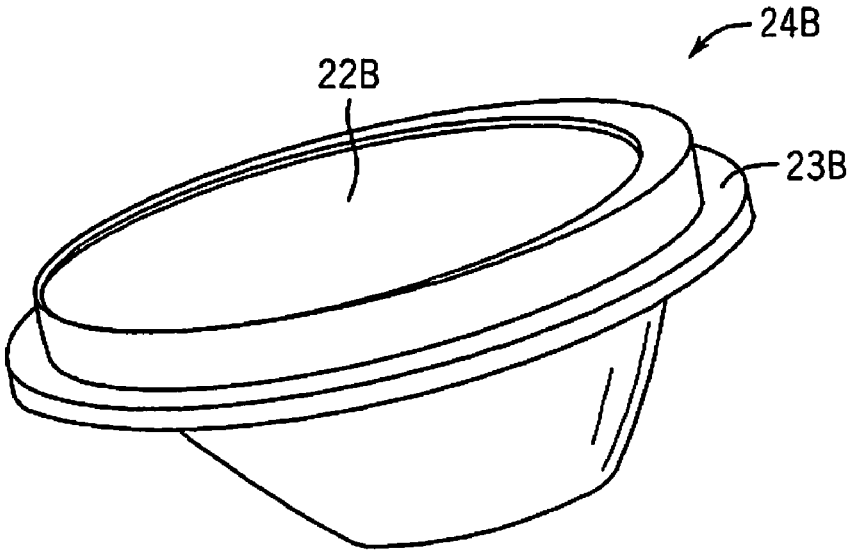
FIG. 11 is an enlarged perspective view of one type of the lens member.
Figure 12:
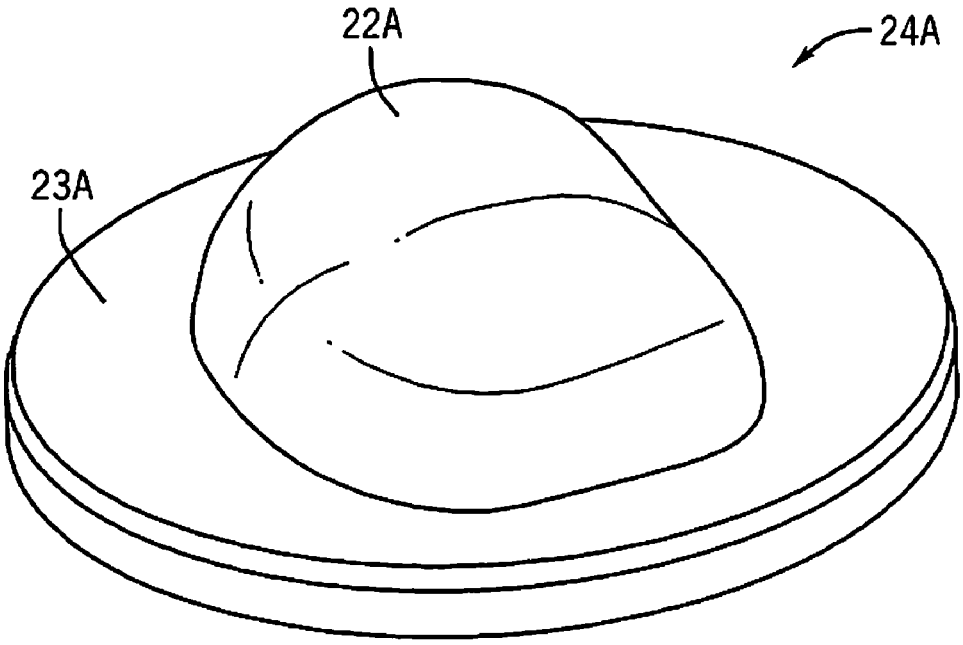
FIG. 12 is an enlarged perspective view of another type of the lens member.
Figure 13:
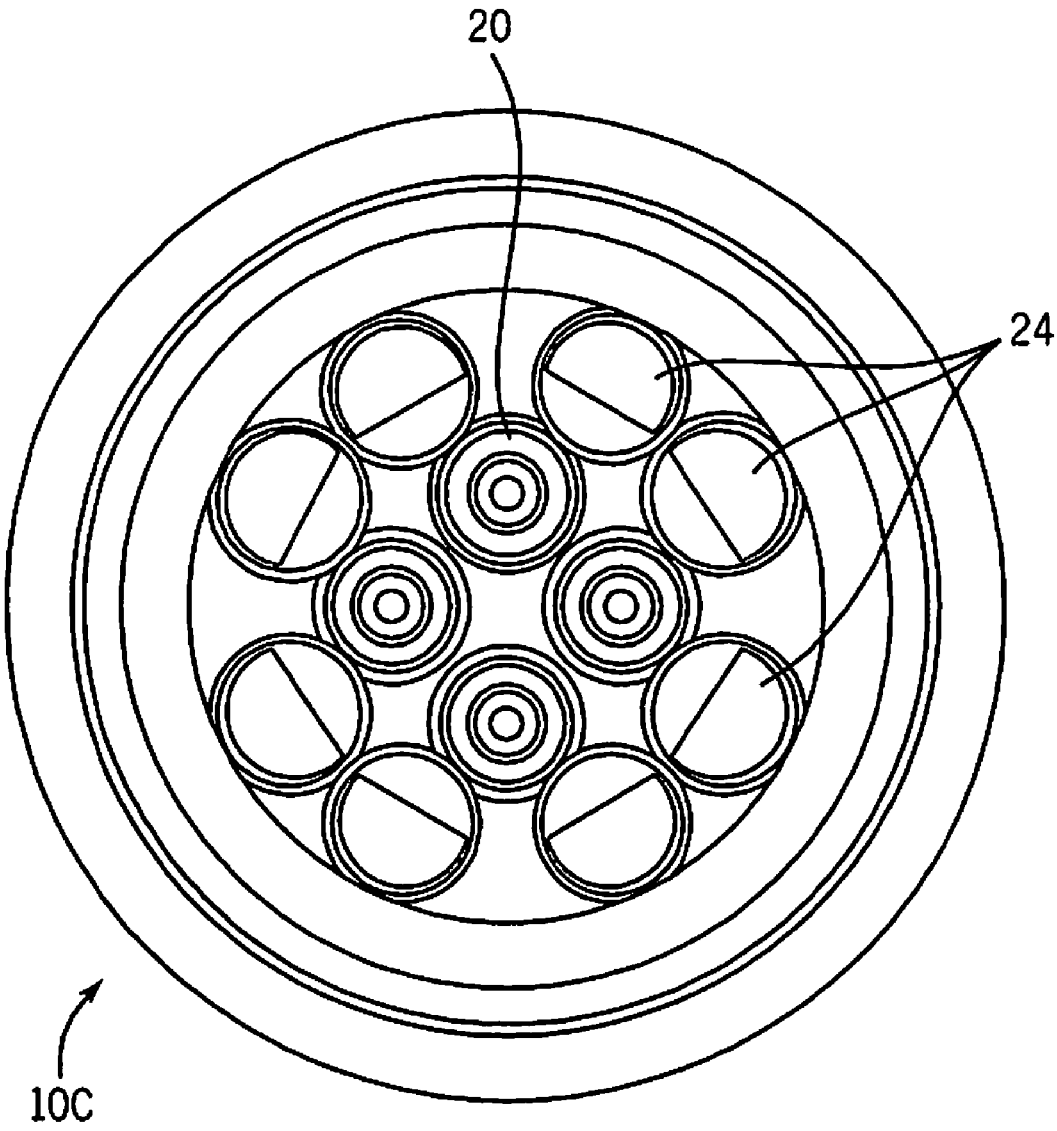
FIG. 13 is an enlarged front elevation of another embodiment of the present invention with the LED apparatus having a round shape.

FIGS. 10 and 14-17 illustrate LED apparatuses 10B, D and E with lens members 24 configured such that each of them refracts light emitted by its respective LED device 11 in a predominantly off-axis direction. FIG. 13 illustrates LED apparatus 13C including only a subset of lens members 24. FIGS. 7-9, 10 and 12 show one example of lens members 24A which are used in lighting fixtures of the type shown in FIGS. 14-17. FIG. 11 shows another example of lens member 24B which is used in recessed lighting fixtures of the type shown in FIG. 13. The lighting fixture shown in FIG. 13 is disclosed in detail in commonly owned U.S. patent application Ser. No. 12/471,881, filed on May 26, 2009, entire contents of which are incorporated herein by reference.

Figure 14:
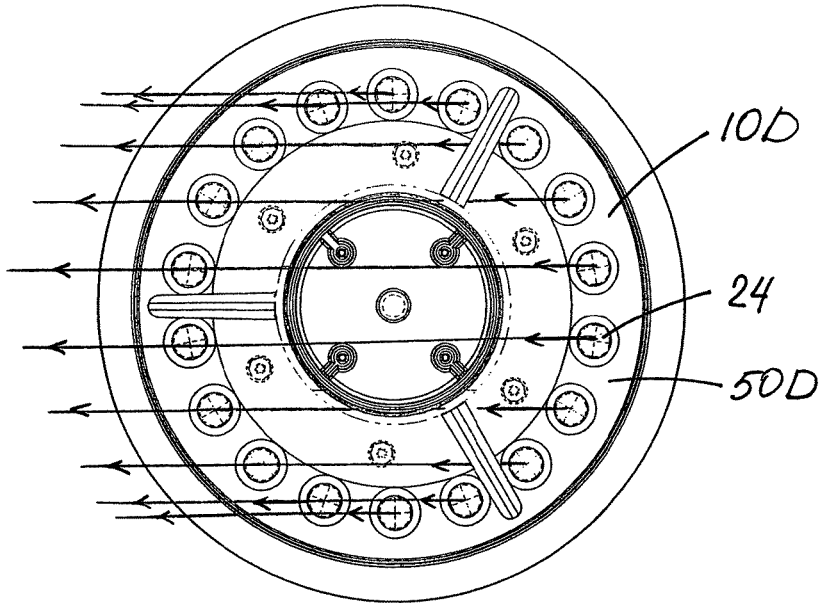
FIG. 14 is a bottom elevation of one exemplary lighting fixture incorporating the inventive LED apparatus with lens members oriented to refract LED light in a common off-axial direction.
Figure 15:
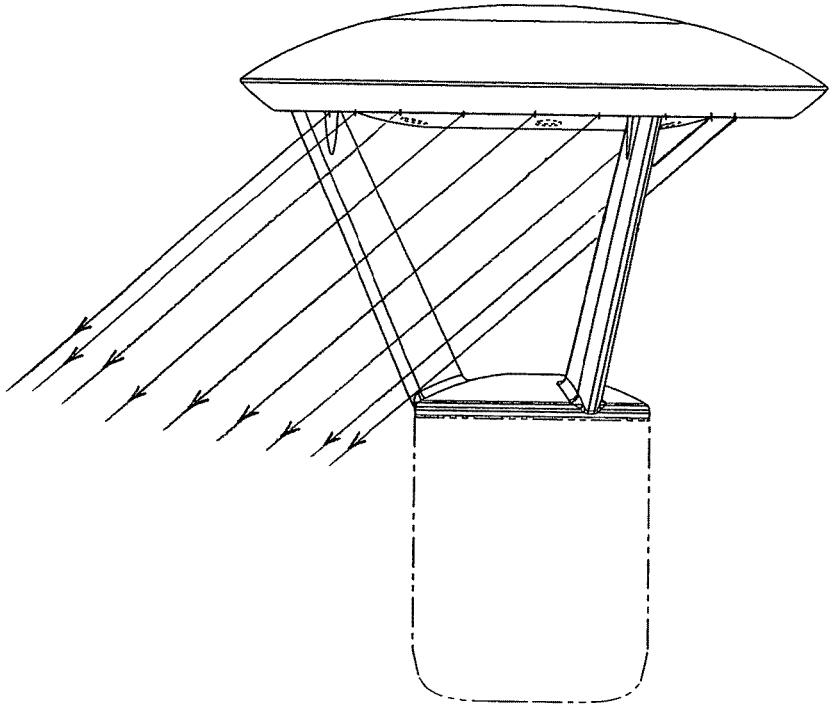
FIG. 15 is a side elevation of the lighting fixture of FIG. 14.
Figure 16:
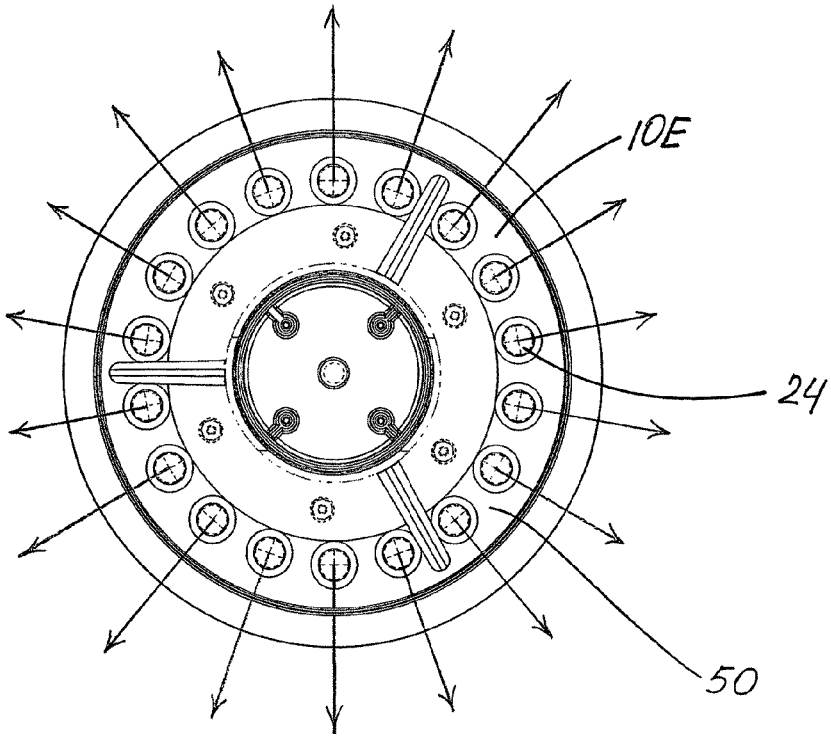
FIG. 16 is a bottom elevation of another exemplary lighting fixture incorporating the inventive LED apparatus with lens members oriented to refract LED light in substantially different off-axis directions.
Figure 17:
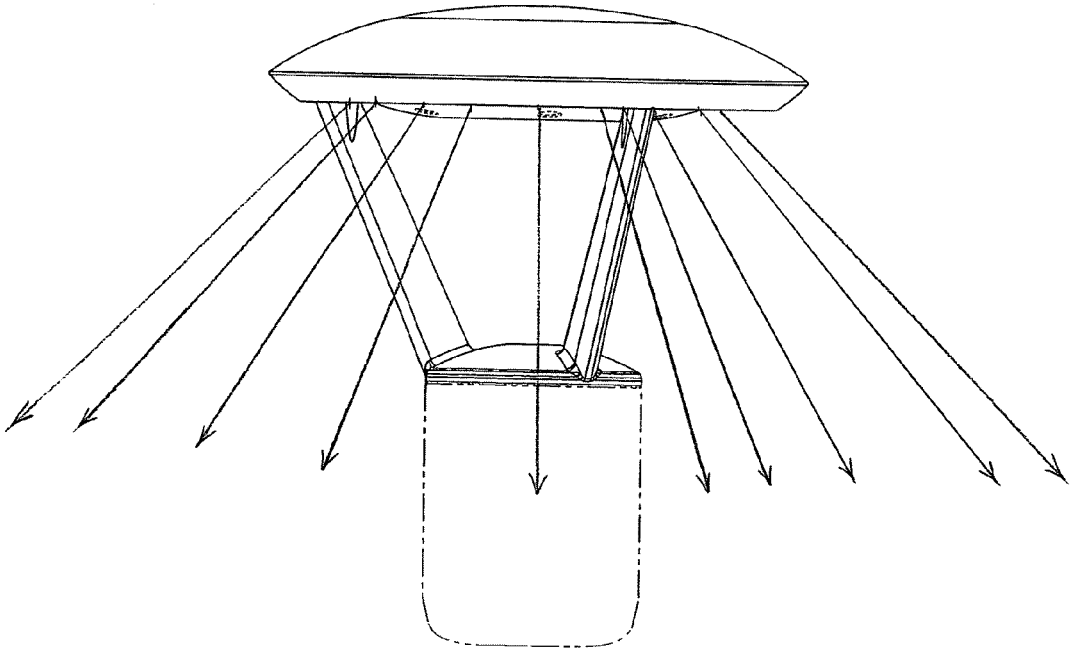
FIG. 17 is a side elevation of the lighting fixture of FIG. 16.

FIGS. 14 and 15 show lens members 24 arranged to refract light in a common off-axis direction. FIGS. 13, 16 and 17 show lens members 24 arranged to be oriented to refract the light in substantially different off-axis directions which are best illustrated in FIGS. 16 and 17.

Another aspect of the present invention is a method for assembly of inventive LED apparatus 10. As seen in FIG. 10, the method includes the steps of providing lens member 20, lens-aligning member 40 with and mounting board 30 with LED device 11 thereon.

FIGS. 7-9 show lens-member flange 23 attached to front surface 41 of lens-aligning member 40. In FIGS. 7-9, flange 23 is attached to lens-aligning member 40 with a chemical bond by ultrasonic welding during which an attachment protrusion 49, which is seen in FIGS. 4-6, is ultrasonically welded with flange 23, as best seen in FIGS. 7-9. Attaching step 80 also includes a prior step 81 of positioning lens-member 20 on lens-aligning-member front surface 41 such that guide-projections' lateral surfaces 46 engage the edge of lens-member flange 23.

Lens-aligning member 40 is placed over mounting board 30, as seen in FIG. 9, such that LED device 11 protrudes through aperture 43 beyond front surface 41. First and second mating features 44 and 34 are engaged to accurately align lens member 20 over LED device 11 by accurately aligning lens-aligning member 40 with mounting board 30. It is further seen in FIG. 9 that lens portion 22 substantially surrounds protruding LED device 11 establishing light path 21 therebetween. Therefore, lens member 20 is secured over LED device 11 by securing lens-aligning member 40 with respect to mounting board 30, as just shown and described.

As seen in FIGS. 1 and 2, the inventive method includes further steps of providing gasket member 60, cover 50 and heat sink 71. The step of securing lens-aligning member 40 with respect to mounting board 30 is by compressing gasket 60 with lens-aligning member 40 and mounting board 30 between cover 50 and heat sink 71. This provides a weather-proof seal about LED device 11 within LED-apparatus interior 13. The inventive method preferably includes the further step 84 of vacuum testing the seal for water-air/tightness of LED-apparatus interior 13.

FIG. 10 further shows that a shield member 65 is further provided and is positioned between cover 50 and gasket 60 for blocking undesired backlighting. Shield member 65 is shown in the form of a layer. More specifically, shield member 65 may be of the type described in commonly owned U.S. patent application Ser. No. 11/743,961, filed on May 3, 2007, entire contents of which are incorporated herein by reference.

Figure 18:
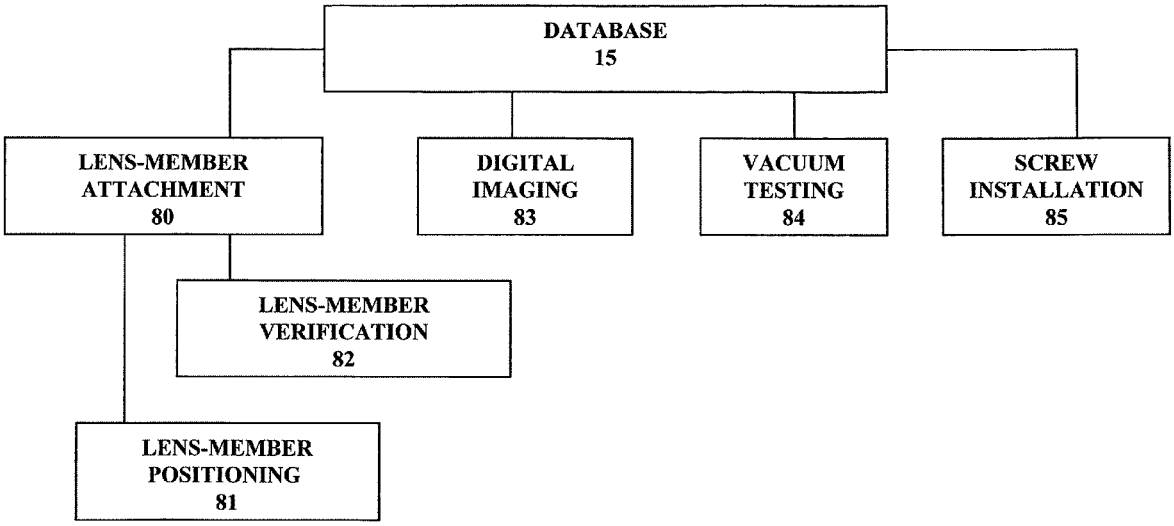
FIG. 18 is a diagram including steps of the inventive method for LED-apparatus assembly.

The method schematically shown in FIG. 18 further includes the step of providing a central database 15, whereby central database 15 provides assembly and testing parameters. It is also preferred that the method of the present invention is performed by an automated system receiving instructions from central database 15 for each particular step preformed by automated tool(s). Central database 15 collects and stores data related to all or at least one of: LED device 11 and lens-member type, selection and orientation of lens member 20, screw torque, vacuum testing parameters, light output and color testing procedures. An SQL (Structured Query Language) database system may be utilized to control and record all testing parameters and results.

In the embodiments for assembling LED apparatuses 10 with a plurality of spaced-apart LED devices 11 and a plurality of lens members 20, prior to attaching step 80, a specific type of lens member 20 is selected. Such selected lens members 20 are positioned on front surface 41 of lens-aligning member 40. The type of each lens member 20 and its orientation are verified in step 82.

When a plurality of LED apparatuses are assembled, each apparatus may require different lens members 20 placed in different locations and in different orientations. Data related to a specific lens members 20 to be utilized is received by the robot from database 15 and identified lens members 20 are placed into interior 13. Each lens member 20 is then verified to be the correct type of lens member and to be positioned in specified orientation. For such identification and verification, lens member 20 may include a machine-identifiable lens-indicia which can be in a form of a bar code, text or a specific shape which indicates a specified orientation. One example of automated devices used for step 82 is a Cognex Insight 5603 Digital Vision Camera which is associated with the Flex-Picker Robot. After lens member 20 is put into place, the camera can read the indicia. The data from such reading is sent back to database 15 for storage.

FIGS. 1, 2 and 10 show that cover 50 includes a plurality of screw holes 52. Prior to step 84 of vacuum testing, the method includes the steps 85 of inserting a screw 14 into all but one of the plurality of screw holes 52. The step of screw installation 85 is then performed to seal interior 13. It is preferred that a transducerized electronic screwdriver with parametric control be utilized. For example, a Chicago Pneumatic Techmotive SD25 Series electric screwdriver with CS2700 controller is capable of performing this step. Data related to the amount of torque to be utilized is received by the screwdriver from database 15. In screw-installation step 85, initially all screws 14 but one are put into screw holes 52. Data related to the actual torque applied to secure screws 14 is then sent to database 15 for storage.

Cover 50 also includes a power connection 53 shown in the form of a wireway opening 54 which allows passage of wires (not shown) from a lighting fixture to LED apparatus 10 for powering LED devices 11.

One remaining screw hole 52 is used for vacuum testing 84 to ensure water/air-tight seal of interior 13. One example of a vacuum testing apparatus is a Uson Sprint IQ Multi-Function Leak & Flow Tester which can be utilized in vacuum-testing step 84. In step 84, wireway opening 54 is temporarily sealed and a vacuum is applied via the open screw hole 52. The vacuum is applied according to data from database 15. Actual vacuum-test results are sent back to database 15 for storage. After vacuum testing 84, final screw 14 is secured in same manner as described above.

The inventive method includes further step 83 of powering LED device 11 and imaging LED apparatus 10 to test light-output characteristics. When LED apparatus 10 is fully assembled, a power is provided to LED emitter 11 through electrical connections which may be printed or otherwise provided on mounting board 30. An image of powered LED device 10 is then taken to test light-output characteristics. The image of LED apparatus 10 is utilized to test intensity, light distribution and color temperature of the LED device(s).

The imaging and analysis of LED apparatus 10 are done through an automated system. One example of such system is a National Instruments Digital Vision Camera utilizing LabView Developer Suite software which can be utilized to complete digital-imaging step 83. A digital image of powered LED apparatus 10 is taken. From this image the software can analyze light output, color characteristics, intensity and light distribution. Data related to these parameters are then sent to database 15 for storage.

Through the described inventive method, individual results can be tracked in a mass-production setting. In such mass-production setting, each individual LED apparatus 10 can include a unique machine-identifiable module-marking which may be a combination of a text with a set of symbols and a bar code. Data related to each individual LED apparatus 10 from each automated step (lens-member positioning and verification 80 and 81, screw installation 85, vacuum testing 84 and digital imaging 83) is then associated in database 15 with the unique machine-identifiable module-marking.

While the principles of this invention have been described in connection with specific embodiments, it should be understood clearly that these descriptions are made only by way of example and are not intended to limit the scope of the invention.

The invention claimed is:

1. An LED apparatus including:

a mounting board supporting at least one LED device thereon, the mounting board having a mating feature which is one of a protrusion and a complementary hollow;

a lens-aligning member having front and back surfaces with at least one lens member being on the front surface, the at least one lens member corresponding to the at least one LED device, and the back surface having an alignment feature which is the other of the protrusion and the complementary hollow in mating engagement with the mating feature of the mounting board, the lens-aligning member being between the mounting board and the lens member, whereby the lens member is aligned over the LED device thereby establishing a light path therebetween.

2. The LED apparatus of claim 1 wherein the back surface of the lens-aligning member abuts an LED-supporting surface of the mounting board.

3. The LED apparatus of claim 2 wherein:

the protrusion extends from the back surface of the lens-aligning member; and the complementary hollow is formed in the LED-supporting surface of the mounting board and receives the protrusion.

4. The LED apparatus of claim 3 wherein each of the back surface of the lens-aligning member and the LED-supporting surface of the mounting board have a pair of the alignment and mating features.

5. The LED apparatus of claim 1 wherein:

the lens member includes a lens portion and a flange thereabout, the flange being attached to the front surface of the lens-aligning member such that the lens portion substantially surrounds the LED device; and the front surface of the lens-aligning member has guide projections extending therefrom with lateral surfaces engaging the edge of the lens-member flange.

6. The LED apparatus of claim 1 wherein:

the lens member includes a lens portion and a flange thereabout; and the front surface of the lens-aligning member includes a recess configured to snugly receive the flange therein.

7. The LED apparatus of claim 6 wherein the lens-aligning-member front surface has guide projections extending therefrom with lateral surfaces along the wall of the recess, the recess wall and the lateral surfaces engaging the edge of the lens-member flange.

8. The LED apparatus of claim 1 further including:

a cover defining an opening aligned with the light path; and a gasket pressed with the lens-aligning member between the cover and the mounting board thereby securing the lens member over the LED device.

9. The LED apparatus of claim 8 further including a base member, the base member and the cover together defining an LED-apparatus interior which encloses and compresses the gasket with the lens-aligning member and the mounting board between the cover and the base member, thereby to provide a weather-proof seal about the LED device.

10. The LED apparatus of claim 9 wherein the base member is a heat sink providing heat dissipation from the LED device during operation.

11. The LED apparatus of claim 1 wherein the lens-aligning member is a fireproof safety barrier having sufficient thickness for enclosure of electrical elements on the mounting board.

12. The LED apparatus of claim 1 wherein the at least one LED device includes a plurality of LED devices spaced from one another on the mounting board, each LED device defining a light-emission axis;

the at least one lens member includes a plurality of lens members each establishing a light path with a respective one of the LED devices;

the lens-aligning member defining a plurality of apertures each for a respective one of the LED devices; and each lens member being attached to the front surface of the lens-aligning member with the lens portion substantially surrounding the respective one of the LED devices.

13. The LED apparatus of claim 12 wherein:

at least a subset of the lens members includes lens members configured such that each of them refracts light emitted by its respective LED device in a predominantly off-axis direction; and the lens members of such subset are arranged on the lens-aligning member to refract light in a common off-axis direction.

14. The LED apparatus of claim 12 wherein:

at least a subset of the lens members includes lens members configured such that each of them refracts light emitted by its respective LED device in a predominantly off-axis direction; and the lens members of such subset are arranged on the lens-aligning member such that at least two are oriented to refract the light in substantially different off-axis directions.

15. A method for assembly of an LED-apparatus, the method comprising the steps of:

providing a mating feature on a mounting board which has at least one LED device thereon, the mating feature being one of the protrusion and a complementary hollow;

providing a lens-aligning member having front and back surfaces, the back surface having an alignment feature being the other of the protrusion and a complementary hollow positioned and arranged for engagement with the mating feature of the mounting board;

providing at least one lens member on the front surface of the lens-aligning member, the at least one lens member corresponding to the at least one LED device;

aligning the lens-aligning member with the mounting board by placing the lens-aligning member between the lens member and the mounting board such that the alignment and mating features engage one another, thereby aligning the lens member over the LED device and establishing a light path therebetween; and securing the lens-aligning member with respect to the mounting board.

16. The method of claim 15 wherein the back surface of the lens-aligning member abuts an LED-supporting surface of the mounting board.

17. The method of claim 16 wherein the protrusion extends from the back surface of the lens-aligning member and the complementary hollow is formed in the mounting board and receives the protrusion.

18. The method of claim 15 including further steps of powering the LED device and imaging the LED apparatus to test light-output characteristics.

19. The method of claim 15 wherein:

the lens member includes a lens portion and a flange thereabout; and the front surface of the lens-aligning member has guide members with lateral surfaces engaging the edge of the lens-member flange; and the attaching step includes a prior step of positioning the lens-member on the front surface of the lens-aligning member to engage the flange edge by the guide-members lateral surfaces.

20. The method of claim 15 including the further steps of:

providing a gasket member and a cover defining an opening aligned with the light path; and providing a heat sink, the heat sink and the cover together defining an LED-apparatus interior, wherein the securing step is by compressing the gasket, with the lens-aligning member and the mounting board between the cover and the heat sink, thereby to provide a weather-proof seal about the LED device within the LED-apparatus interior.

21. The method of claim 20 including the further step of vacuum testing the seal for water-air/tightness of the LED-apparatus interior.

22. The method of claim 15 wherein:

the at least one LED device includes a plurality of spaced-apart LED devices, each LED device defining a light-emission axis;

the lens-aligning member includes a plurality of apertures each for a respective one of the LED devices;

the at least one lens member includes a plurality of lens members having at least a subset of the lens members including lens members configured to refract light emitted by its respective LED device in a predominantly off-axis direction; and the step of providing at least one lens member includes the steps of:

selecting a specific type of the lens member;

positioning the lens member on the front surface of the lens-aligning member;

verifying the type of the lens member and its orientation; and attaching each lens-member to the front surface of the lens-support member.

23. The method of claim 22 wherein the lens members of the subset are arranged on the lens-aligning member to refract light in a common off-axis direction.

24. The method of claim 22 wherein the lens members of the subset are arranged on the lens-aligning member such that at least two are oriented to refract the light in substantially different off-axis directions.

25. A method for assembling custom LED-array modules of the type including a plurality of separate lens members each configured for a specific type of light distribution, and a plurality of LED devices spaced from one another on a mounting board, the method comprising the steps of:

providing a mating feature on the mounting board, the mating feature being one of the protrusion and a complementary hollow;

providing a lens-support member having front and back surfaces, the back surface having an alignment feature, being the other of the protrusion and a complementary hollow, the alignment and mating features being positioned and arranged for engagement with one another;

determining a desired light distribution of the LED-array module;

selecting specific type(s) of the lens members to achieve the desired light distribution;

positioning the selected lens members on the front surface of the lens-support member;

verifying the type and orientation of each lens member;

attaching each lens-member to the front surface of the lens-support member;

aligning the lens-support member with the mounting board through engagement of the alignment and mating features by placing the lens-support member between the lens member and the mounting board such that each lens member substantially surrounds LED device; and securing the lens-support member with the lens members attached thereto with respect to the mounting board, thereby achieving alignment of each lens member over a respective one of the LED devices while accommodating different desired light-distribution patterns.

26. The method of claim 25 wherein:

at least a subset of the lens members includes lens members configured such that each of them refracts light emitted by its respective LED device in a predominantly off-axis direction; and the lens members of such subset are arranged on the lens-support member to refract light in a common off-axis direction.

27. The method of claim 25 wherein:

at least a subset of the lens members includes lens members configured such that each of them refracts light emitted by its respective LED device in a predominantly off-axis direction; and the lens members of such subset are arranged on the lens-support member such that at least two are oriented to refract the light in substantially different off-axis directions.

28. The method of claim 25 wherein:

at least the steps of positioning and verifying are performed by a robot incorporating a vision system, the robot being at a single first location; and steps of incorporating the LED-array modules into light fixtures are performed at multiple locations remote from the first location, whereby eliminating the need for the robot at the multiple locations.

* * * * *